United States Patent [19]

Long

[11] Patent Number: 4,798,389

[45] Date of Patent: Jan. 17, 1989

[54] APPARATUS FOR PLAYING INDOOR BASEBALL INDOOR SOFT BALL OR INDOOR TEE-BALL

[75] Inventor: Geoffrey E. Long, Leeming, Australia

[73] Assignee: Long Enterprises Pty. Ltd., West Perth, Australia

[21] Appl. No.: 29,548

[22] Filed: Mar. 24, 1987

[30] Foreign Application Priority Data

Mar. 27, 1986 [AU] Australia ..... PH 5239

[51] Int. Cl.[4] ..... A63B 67/00

[52] U.S. Cl. ..... 273/411; 273/25

[58] Field of Search ..... 273/411, 85 R, 26 R

[56] References Cited

U.S. PATENT DOCUMENTS 3,830,497 8/1974 Peterson ..... 273/411

OTHER PUBLICATIONS

Washington Post, 11/9/80, p. N14.

*Primary Examiner*—Richard C. Pinkham
*Assistant Examiner*—T. Brown
*Attorney, Agent, or Firm*—John S. Hale

[57] ABSTRACT

The present invention relates to an appartus for playing indoor baseball, indoor softball or indoor tee-ball which comprises an arena having a playing area provided, with a circuit defined by a plurality of bases including a home base. The area further having first and second zones wherein the second zone contains at least one base other than the home base, there being a position on a boundary of the first zone defining the points of closest approach of a fielder of the at least one base to the at least one base until such time as the ball is caused to move such that play is commenced in respect of a batter's individual facing of a respective delivery of the ball.

6 Claims, 4 Drawing Sheets

APPARATUS FOR PLAYING INDOOR BASEBALL INDOOR SOFT BALL OR INDOOR TEE-BALL

BACKGROUND AND SUMMARY OF THE INVENTION

The present invention relates to indoor games and in particular to apparatus for playing indoor baseball, indoor softball or indoor tee-ball. In accordance with one aspect of the present invention there is provided an apparatus for playing indoor baseball, indoor softball or indoor tee-ball by a plurality of players of opposing teams comprising a batting team and a fielding team, the batting team being comprised of batters and the fielding team being comprised of fielders and at lest one pitcher for pitching a ball, said apparatus comprising; an arena having a playing area provided with a circuit defined by a plurality of bases including a home base; wall means surrounding the playing area and roof means overlying the playing area above the wall means with boundary lines limiting the playing area. At least two dividing lines extend between the boundary lines such that the playing area is divided into a least three zones, being a first zone, a second zone and a third zone with one of the dividing lines separating the first a one and second zone and another of the dividing lines separating the second zone and third zone. At least one base of the plurality of bases, not being the home base is located in the second zone and at least one of the fielders allocated to the base located in the second zone, one of the batter being positioned in the third zone to take strikes from the pitcher. The dividing line separating the first zone and the second zone defines the closest permissable approach to the base located in the second zone by the fielder of that base prior to the pitcher pitching the ball to the batter on each occasion that the batter takes a strike, such that fielder of the base located in the second zone will be positioned outside the second zone until the pitcher pitches the ball on each occasion that the batter takes a strike.

In accordance with a preferred aspect of the present invention, there are four bases, including the home base, and the first zone contains the positions of both the first and third base fielders.

In accordance with a further preferred aspect of the present invention, the first zone also contains a base. Preferably, the playing area comprises a first zone containing one base, a second zone containing two bases and a third zone containing a home base, such that the fielding positions of the first base fielder and third base fielder are located in the first zone. The fielding position of the second base fielder is preferably located in the first zone and the fielding positions of the left outfield fielder and the right outfield fielder are preferably located in the first zone. In the games of indoor softball and indoor tee-ball the pitcher's position is preferably located in the second zone whilst in the game of indoor baseball, the pitcher's position is preferably located in the first zone. Further, a catcher is preferably located in the region backward of the home base plate in the third zone, in each of the three games. Also, an umpire may be provided. In the case of indoor tee-ball, the umpire is preferably located in the region backward of the home base plate in the third zone. In the case of indoor baseball or indoor softball, the umpire is preferably located outside the arena, behind and in line with the home base plate, but may stand inside the arena. The present invention will now be described, by way of example, with reference to the accompanying drawings, in which:

DETAILED DESCRIPTION OF THE INVENTION

Figure 1:
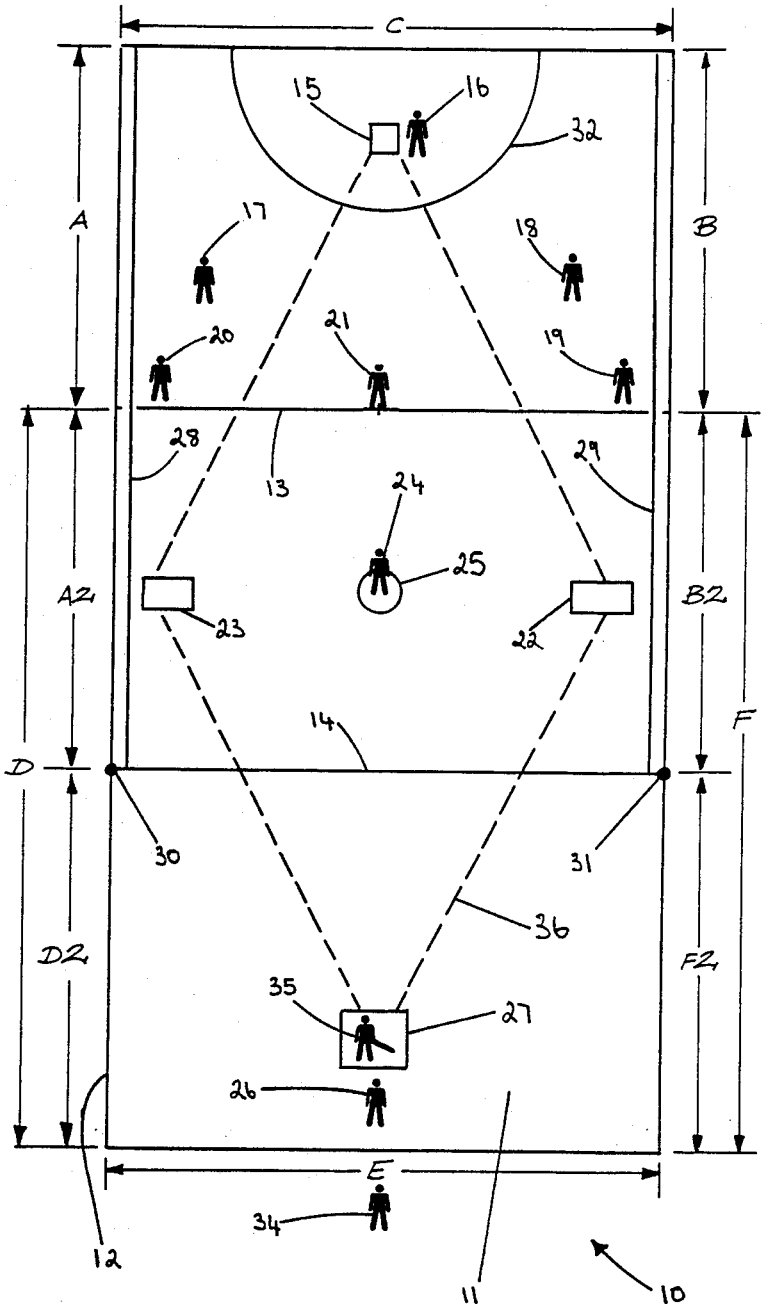
FIG. 1 is a plan view of the playing area forming part of the apparatus for playing the indoor baseball or indoor softball games of the present invention.

In FIG. 1 there is shown a playing arena 10 comprising an oblong or rectangular playing area 11.

Figure 3:
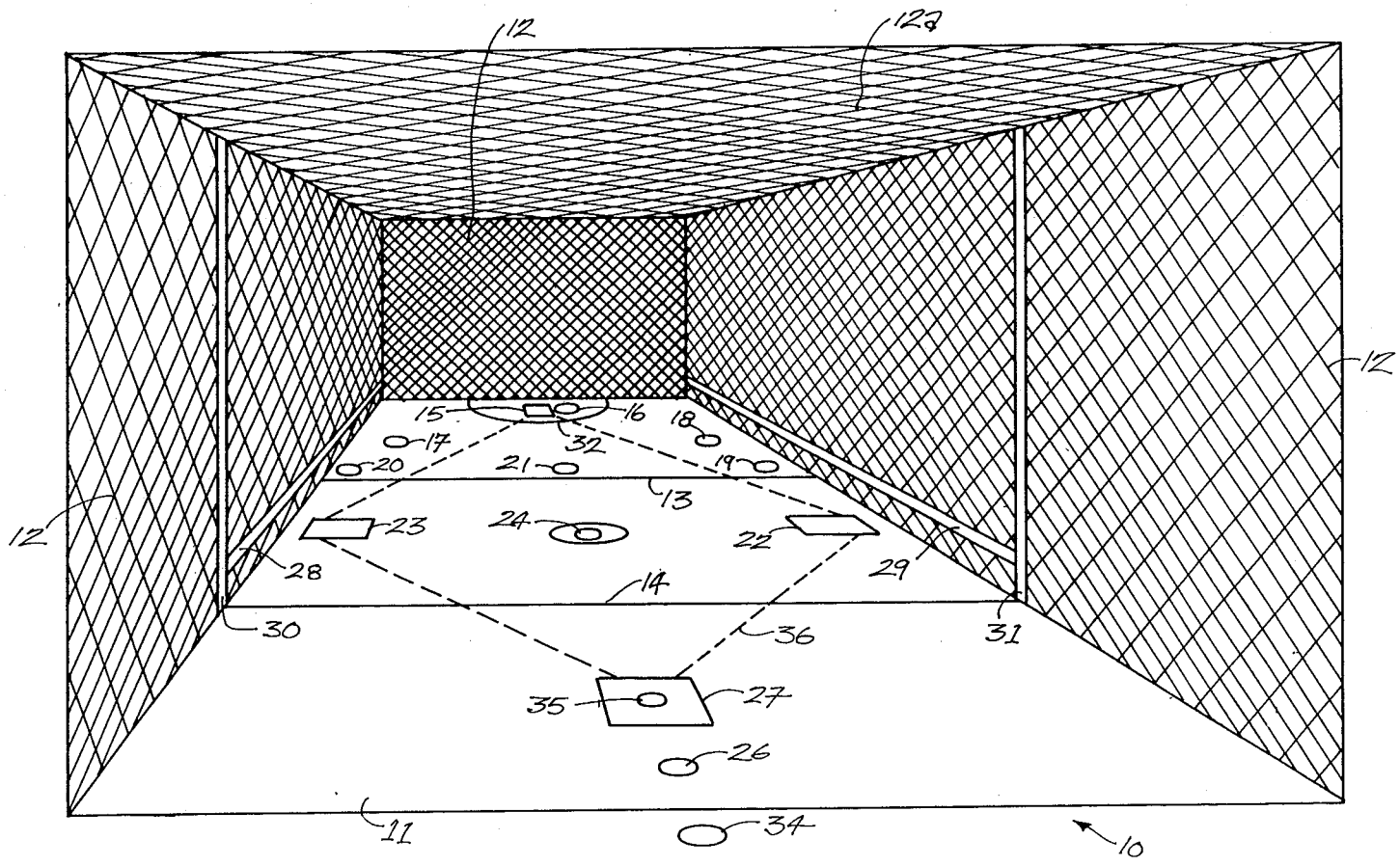
FIG. 3 and 4 show the playing fields of FIGS. 1 and 2 surrounded by an enclosure, the side walls of the enclosures having horizontal bonus lines.
Figure 4:
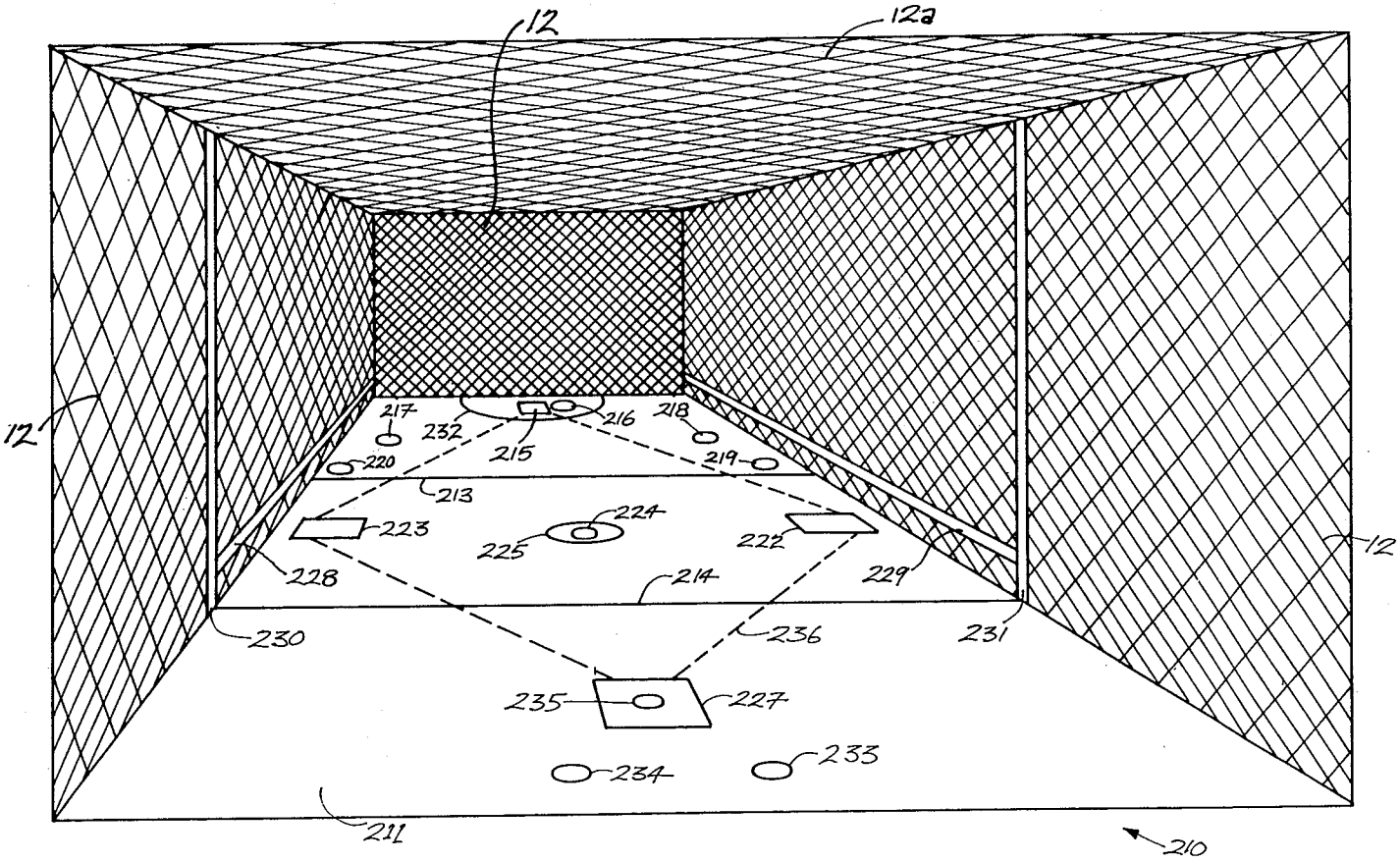

The playing area is surrounded on all sides by walls 12 which are conveniently formed of a mesh material, but may be formed of any suitable material. Further, the playing arena 10 preferably comprises a roof (FIGS. 3 and 4) overlying the walls 12 so as to completely enclose the playing area 11. The roof may also be formed of a mesh material.

The playing area 11 is divided into zones. A first zone is determined by the parts A, C and B of the walls 12 and a painted zone line 13 running parallel to the part C of the walls 12. A second zone is determined by the parts A2 and B2 of the walls 12, the painted zone line 13 and a painted foul line 14 also parallel to the part C of the walls 12 and spaced from the painted zone line 13 by the length of the part A2 of the walls 12.

The marked foul line 14 (which is marked for indoor baseball, indoor softball or indoor tee-ball on the actual playing area 11) has been shown in FIG. 1 as a line 14.

A third zone is determined by the said painted foul line 14 and the parts D2, F2 and E of the walls 12. The playing area 11 may be so divided that the first, second and third zones are of equal area.

The first zone contains the second base 15 along with the fielding positions of the second base fielder 16, left outfield and right outfield fielders 17 and 18, respectively, and the first base and third base fielders 19 and 20, respectively. Preferably, the fielding positions of the first and third base fielders 19 and 20 are substantially adjacent the painted zone line 13, at opposed ends thereof. Preferably, the fielding position of the second base fielder 16 is substantially adjacent the second base 15.

In the case of indoor baseball, the first zone also contains the pitcher's position 21. Preferably, the pitcher's position 21 is substantially adjacent the painted zone line 13, midway between the ends thereof. The second zone contains the first and third bases 22 and 23 respectively.

In the case of indoor softball, the second zone also contains the position of the pitcher 24 conventionally shown by way of a circle 25, but which may also be a short line (not shown) parallel to line 14 at the same location as the circle 25.

The third zone contains the home base plate/batting box 27 and the position of the catcher 26. The home base plate/batting box 27 is a square, preferably of size 46 cm×46cm. Catcher 26 is located behind the home base plate/batting box 27. The batter 35 is shown at the home base plate/batting box 27.

The umpire 34 is located outside the third zone and outside or inside the playing arena 10, immediately behind the home base plate/batting box 27.

The two longest of the side walls 12 have marked thereon two horizontal bonus lines 28 and 29 which run the length of the parts A, A2 and B, B2, respectively, of these two walls. The horizontal bonus lines 28 and 29 extend from the back part C of the walls 12 to respective upright foul lines 30 and 31. The marked foul line 14 may conveniently terminate at respective ends at one of the upright foul lines 30 and 31.

The upright vertical foul lines extend from the floor of the playing area 11 to the roof of the arena, at the junction of the second and third zones, along the side walls of the arena.

The purpose of the upright foul lines 30 and 31 is to determine a foul ball zone. Accordingly, the third zone defines the foul ball zone. Any ball hit into the parts D2 or F2 of the walls 12 of the foul ball zone or any ball remaining in the foul ball zone, after being hit, may be declared a foul ball.

The broken line 36 indicates the circuit path that is generally followed by a batter around the bases 22, 15 and 23. Preferably, it would not appear on an actual playing arena, but may be included if required.

Figure 2:
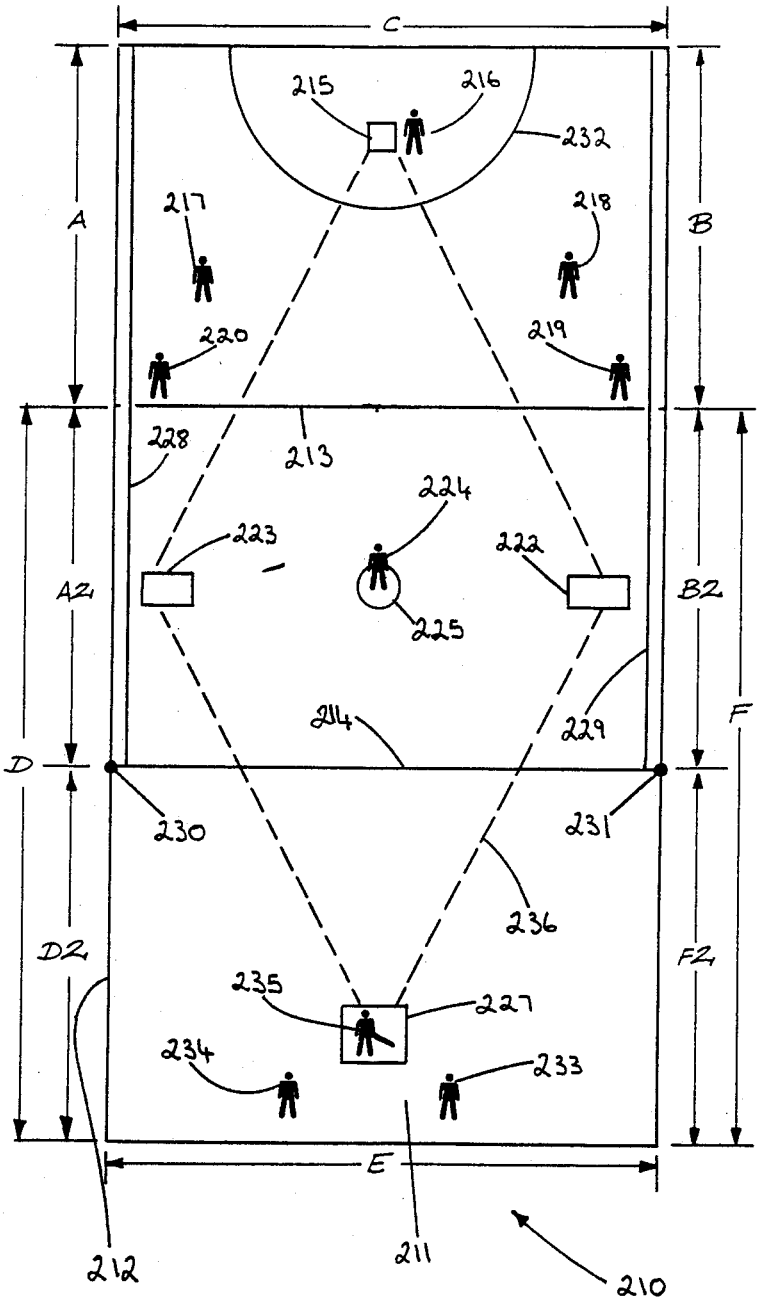
FIG. 2 is a plan view of the playing area forming part of the apparatus for playing the indoor tee-ball game of the present invention

FIG. 2 shows the playing arena 210 for the game of indoor tee-ball. As can be seen, FIG. 2 is similar to FIG. 1 and the same reference numerals are used in FIGS. 1 and 2 to depict the same integers except that in FIG. 2 the digit "2" precedes all of the references.

The above description in relation to the arena for playing indoor baseball and indoor softball applies in every respect to indoor tee-ball with the following exceptions.

Firstly, the catcher 233 is positioned behind and to one side of the batter and the umpire 234 is also located in the third zone. The pitcher's position is (as in the case of indoor softball) located in the second zone as indicated by reference 224 and the circle 225.

The manner of using the apparatus shall now be described with reference to the rules of the games and the accompanying drawings, with any variations between the three games being noted. Also, it is to be noted that the normal rules of baseball, softball and tee-ball are applicable except as they are specifically modified for the playing of indoor basketball, indoor softball and indoor tee-ball as described herein.

Each team preferably has seven players. However, a game may commence with only five players per side. In such a case, the players bat in a fixed consecutive batting order. However, if a game commences with five players but other players subsequently arrive, it is preferable that the latter arriving players enter the game only between innings.

The teams take turn in batting and fielding with the end of each innings being determined by three batters out or seven batters completing their turn to bat.

Upon striking the ball, in a legitimate manner (and not playing a strike or a foul) the batter 35, 235 may run to the first base 22, 222. His batting place is taken by another batter who plays in similar manner. However, only one player from the batting team may occupy any one base at any one time so that if one player of the batting team runs to a base which is occupied by another player, the other player must run to the next base. When a player runs consecutively through all bases and returns to the home base 27, 227 he scores a run for his team.

Further, in cases of indoor baseball and indoor softball the seventh batter must bat the ball and cannot simply walk. Also, in the cases of indoor baseball and indoor softball, once the seventh batter has hit the ball the batting side may be put out only by an infielder, i.e. first or third base fielders 22 and 23, pitcher 21 or 24 or the catcher 26.

The fielding team provides a pitcher for each innings and all the players of the fielding team take a turn at pitching.

However, in the case of indoor tee-ball, wherein the batter 235 hits the ball off a tee located in the region of the home base plate 227, the pitcher 224 does not in fact pitch the ball but only fields in similar manner to the remainder of the fielding team. The reason for this is that tee-ball is intended for very young players who generally are unable to pitch the ball or hit a pitched ball with the necessary skill required.

As regards umpiring, it is preferable that the plate umpire is supplied by the body making available the arena, a second base umpire (if required) is supplied by the batting team and that the teams supply the scorers. Under the rules of the game, it is preferable that the batters of the batting team each take their turn to bat and further, a batter or runner (i.e. batter/runner), as the case may be, can be out in several ways, e.g., playing three strikes; hitting three foul balls (each foul is a strike); being caught off the parts A or B, of the walls 12 or the roof, except if the ball is deflected into the part C of the wall 12 from the roof, which constitutes a home run and the batter is not then out; being tagged or forced out (by the ball reaching the base before the batter/runner reaches it); a batted live ball hitting a batter/runner whilst running between the bases; (the ball is dead and batters/runners may advance only if forced to do so); and throwing the bat instead of dropping it.

Further, in the case of tee-ball, hitting the tee may be counted as a strike.

As regard scoring, a ball hit directly into the part C of the walls 12 without bouncing on the floor is one home run, and it is preferable that in the cases of indoor baseball, indoor softball and indoor tee-ball a batter cannot be caught out off the wall from such a home run. Further, a ball hit into the part C of the walls 12, after deflecting directly from the roof, is one home run. After a home run has been hit, the ball is deemed dead and all batter/runners on bases will score a run. Also, the batter hitting the home run does not need to run around the bases and he cannot be caught off the walls 12 or roof from a home run.

Scoring may also be achieved by running bases. In this way, one run may be scored each time a batter/runner legitimately reaches any of the first bases 22, 222, second bases 15, 215, third bases 23, 223 or the home plate/batting box 27, 227 before the third player is out for each respective innings. Further, it is preferable that bonus scores be awarded such that if the batter strikes the ball which then hits the side net on the full below the bonus score lines 28 and 29, and 228 and 229 one extra base is awarded. The bonus score lines 28 and 29, and 228 and 229 are marked at a convenient height, preferably 60 cm, above the floor of the playing area 11, 211.

The apparatus of the present invention also provides for foul balls to be played by the batters such that any ball hit into the parts D2 or F2 of the wall 12 of the foul ball zone, or any ball remaining in the foul ball zone after being hit, is a foul ball.

The foul ball zone is determined by the upright foul lines 30 and 31, and 230 and 231, and the painted lines 14, 214 and extends therefrom to the walls E, immediately behind the batter.

Penalties may be awarded against the batter for foul balls. Further, in the case of tee-ball it is preferable that foul balls are also determined by the batter hitting the tee and if the batter places his foot outside the batting box 227 when hitting a teed ball.

As regards the fielding positions of the fielding team, they are preferably as follows.

The catcher is located behind the home base plate but in the case of tee-ball, behind the home base plate and to the side of the batter 235. The pitcher 24, in the case of indoor softball, pitches whilst standing in the centre circle 25 or a straight line in a similar position, parallel to line 14 and may field anywhere i that part of the arena bounded by the parts D, E and F of the walls 12 and the painted zone line 13, whilst in the case of indoor baseball the pitcher 21 preferably pitches from a central position on the painted zone line 13 and fields in the same area as for the pitcher 24 in indoor softball. As previously stated, in the case of indoor tee-ball, the pitcher 224 does not actually pitch the ball but plays as any other fielder and may field in the same area as the pitcher 21, 24 in indoor baseball and indoor softball. As regards the first and third base fielders 19, 219 and 20, 220, they must stand in the first zone (i.e. the second base side of the painted line 13) until the ball leaves the pitcher's hand whilst in the case of tee-ball they must stand in the first zone until the ball is struck by the batter 227.

However, in each game the first and third base fielders 19, 219 and 20, 220 may field (once the ball is pitched or struck) in the area determined by the parts D, E and F of the walls 12, 212 and the painted lines 13, 213 as the case may be. The second base fielder 16, 216 may field only in a semi-circle 32, 232 marked on the playing areas 11, 211. However, in the case of only five players in the fielding team, the second base fielder 16, 216 may field anywhere in the first zone. This semi-circle 32, 232 is marked in the FIGS. 1 and 2 respectively. The left outfield and the right outfield fielders may field in the area determined by the parts A, B and C of the walls 12 and the painted lines 13, 213 as the case may be, i.e. in the first zone. In accordance with the rules, it is preferable that the players supply their own hand mitts and that if the players wish to supply their own bats, that their sizes not exceed 33 in the cases of indoor baseball and indoor softball, and 27 in the case of indoor tee-ball.

Further, the rules may provide for penalties. For example, a player sliding to bases may be declared out. Similarly penalties may be imposed for bad or unsportsman like behaviour such as an offending fielder missing the remainder of the innings and an offending batter losing his turn to bat and declared out.

The winning team is that with the highest score at the expiration of the time allotted for the game.

The preferred times for the games are 1 hour for indoor tee-ball and 1 hour for indoor softball and indoor baseball.

Modifications and variations such as would be apparent to a skilled addressee are deemed within the scope of the present invention.

I claim:

1. Apparatus for the playing of indoor baseball, indoor softball or indoor tee-ball by a plurality of players of opposing teams comprising a batting team and a fielding team, said batting team being comprised of batters and said fielding team being comprised of fielders and at least one pitcher for pitching a ball, said apparatus comprising: an arena having a playing area provided with a circuit defined by a plurality of bases including a home base; wall means surrounding said playing area and roof means overlying said playing area above said wall means; said playing area being defined by at least four boundary lines at least two dividing lines extending between at least two of said boundary lines such that said playing area is divided into a least three zones comprising a first zone, a second zone, and a third zones with one of said dividing lines separating said first zone and said second zone and said third zone; at least separating said second zone and said third zone; at least one base of said plurality of bases, not being said home base, being located in said second zone and at least one of said fielders being allocated to said base located in said second zone; one of said batters being positionable in said third zone to take pitched balls from said pitcher; wherein said dividing line separating said first zone and said second zone defines the closest permissable approach to the said base located in said second zone prior to said pitcher pitching said ball to said batter on each occasion that said batter strikes the ball, such that said fielder will be positioned outside said second zone until said pitcher pitches said ball to said batter on each occasion that said batter strikes the ball.

2. An apparatus according to claim I wherein said arena is provided with bonus run scoring zones.

3. Apparatus according to claim 2 wherein said bonus run scoring zones are defined by at least one bonus run scoring line marked on said wall means substantially above the said boundary lines delimiting said playing area.

4. Apparatus according to claim 1 wherein said plurality of bases comprises a first base, a second base, a third base, said first base and said third base being located in said second zone, said second base being located in said first zone and said home base being located in said third zone.

5. Apparatus according to claim 1 wherein said arena further comprises a foul ball zone coinciding with said third zone, said foul ball zone being further delimited by an upright foul line extending from said playing area to said roof means at the respective ends of the said dividing line separating said second zone and said third zone.

6. Apparatus according to claim 5 wherein said arena is provided with bonus run scoring zones defined by at least one bonus run scoring line marked on said wall means substantially above the said boundary lines delimiting said playing area, said at least one bonus run scoring line extending from a said upright foul line along a portion of said wall means adjacent said first zone and said second zone of said playing area.

* * * * *